United States Patent [19]

Weltmer

[11] 4,298,555

[45] Nov. 3, 1981

[54] MECHANIZED TROWEL FOR FINISHING CONCRETE SLABS

[76] Inventor: John T. Weltmer, 2623 Villa, Clovis, Calif. 93612

[21] Appl. No.: 181,009

[22] Filed: Aug. 25, 1980

[51] Int. Cl.[3] ..... E02D 15/02; E04G 21/10

[52] U.S. Cl. ..... 264/31; 52/744; 264/162; 264/163; 264/256; 264/310; 264/333; 404/72; 404/96; 404/112; 404/118; 425/60; 425/456; 425/472

[58] Field of Search ..... 264/162, 163, 333, 31, 264/33, 293, 310, 349, 69, 72, 119, 232, 256; 425/60, 472, 63, 218, 403, 426, 445, 446, 460, 456; 52/743, 744; 404/72, 96, 112, 118

[56] References Cited

U.S. PATENT DOCUMENTS 3,543,652 12/1970 Kalns ..... 404/118
3,779,661 12/1973 Godbersen ..... 404/72

FOREIGN PATENT DOCUMENTS 939158 7/1949 Fed. Rep. of Germany ..... 404/118
1092944 11/1960 Fed. Rep. of Germany ..... 404/118
686149 3/1965 Italy .

*Primary Examiner*—Willard E. Hoag
*Attorney, Agent, or Firm*—Huebner & Worrel

[57] ABSTRACT

A mechanized trowel including a center body of an elongated configuration supported for rotational displacement about its longitudinal axis and having a helical troweling blade extending along the surface thereof adapted to engage, spread and trowel a body of cement in its plastic state, a supporting rail extended in parallelism with the center body supporting the center body for linear displacement therealong, and a truck supporting the end of the rail for translational displacement about a further axis perpendicularly related to the longitudinal axis of the center body and passing through the end thereof opposite the truck, and reversible, electrically energizable motors connected in driving relation with the center body for imparting thereto rotational, linear and translational displacement.

9 Claims, 13 Drawing Figures

MECHANIZED TROWEL FOR FINISHING CONCRETE SLABS

BACKGROUND OF THE INVENTION

1. Field of the Invention

The invention generally relates to machines for finishing concrete slabs, and more particularly to a method and machine for mechanically finishing dished-shaped concrete slabs of inverted conical configurations having particular utility as foundations for wine tanks and the like.

2. Description of the Prior Art

As can readily be appreciated by those familiar with the art of finishing concrete, substantial time and effort must be devoted to achieving proper slopes, grades and shapes in those instances where such factors are of significance. For example, in the erection of tanks, such as wine tanks and the like, concrete foundations, or bases for the tanks, normally are of an inverted, conical configuration. That is to say, each foundation normally comprises a concave, dished-shaped slab having an annular periphery disposed in a horizontal plane and a center spaced vertically downwardly from the plane of the periphery of the slab. In order to impart the desired shape and slope to the slab, substantial effort heretofore has been required during the finishing of the slab.

As a consequence of the level of skill and the effort usually required in properly shaping slabs employed as foundations for wine tanks and the like, there exists a need for a mechanized trowel, or machine, having a capability of finishing concrete slabs in an economic and facile manner such that desired finishes, shapes, and grades become readily achievable at reduced costs.

During the course of a preliminary search conducted for the invention hereinafter more fully described and claimed, the following patents were discovered:

U.S. Pat. No. 1,731,231; Chenoweth; Oct. 8, 1929
U.S. Pat. No. 3,229,827; Kucera; Jan. 18, 1966
U.S. Pat. No. 3,270,634; Borges; Sept. 6, 1966
U.S. Pat. No. 3,450,011; Godbersen; June 17, 1969
U.S. Pat. No. 4,132,450; Hansen; Jan. 2, 1979
U.S. Pat. No. 4,142,815; Mitchell; Mar. 6, 1979

It is noted that the patent to Chenoweth U.S. Pat. No. 1,731,231 discloses a machine for spreading aggregate or plastic material on surfaces such as roadway surfaces; the patent to Godbersen, U.S. Pat. No. 3,450,011 provides a concrete finishing machine utilizing a traveling carriage for transporting a finishing member transversely over a slab; the patents to Kucera U.S. Pat. No. 3,229,827 and Hansen U.S. Pat. No. 4,132,450, disclose material-handling apparatuses for use in unloading silos; while the patents to Borges and Mitchell were selected simply as being of further interest.

In summary, it is noted that the use of augers for spreading cement is known and also it is known to employ a pivotal auger in handling silage. However, it is believed to be apparent that none of the patents discovered during the course of the search contain a suggestion for a mechanized trowel particularly adapted for finishing concrete slabs of dished-shaped configurations, or that any of the structures disclosed in any of the patents discovered in the search could be so employed.

It is, therefore, the general purpose of the instant invention to provide a machine and method for finishing concrete slabs of circular dished-shaped configurations.

OBJECTS AND SUMMARY OF THE INVENTION

It is an object of the invention to provide a machine and method for finishing concrete slabs.

It is another object to provide a machine and method for finishing concrete slabs of inverted, conical configurations having particular utility as foundations for tanks.

It is another object to provide a mechanized trowel for finishing concrete slabs characterized by a capability for simultaneously pushing plastic cement upwardly, outwardly, and annularly, relative to the center portion of the slab.

It is another object to provide a machine for mechanically finishing dished-shaped concrete slabs of inverted, conical configurations adapted to be selectively operated for simultaneously pushing plastic cement upwardly, outwardly, and annularly relative to the center of the slab, for producing dished-shaped slabs to be employed as bases for wine tanks at reduced costs, as will become more readily apparent by reference to the following description and claims in light of the accompanying drawings.

It is another object to provide a machine for finishing dished-shaped concrete slabs of inverted conical configurations, although not necessarily restricted in use thereto since the machine can be employed for finishing concrete slabs of other shapes, such as flat disks and the like.

These and other objects and advantages are achieved through the use of a machine comprising a mechanized trowel including an elongated center body supported for rotational displacement about its longitudinal axis having a helical troweling blade extending along the surface thereof adapted to spread and trowel a body of cement while in its plastic state, a supporting rail supporting the center body for linear displacement therealong along the rail, and a truck supporting the end of the rail for translational displacement about a further axis perpendicularly related to the longitudinal axis of the center body passing through the end thereof opposite the truck, and reversable, electrically energizable motors connected in driving relation with the center body for imparting thereto rotational, linear and translational displacement.

DESCRIPTION OF THE PREFERRED EMBODIMENT

Figure 1:
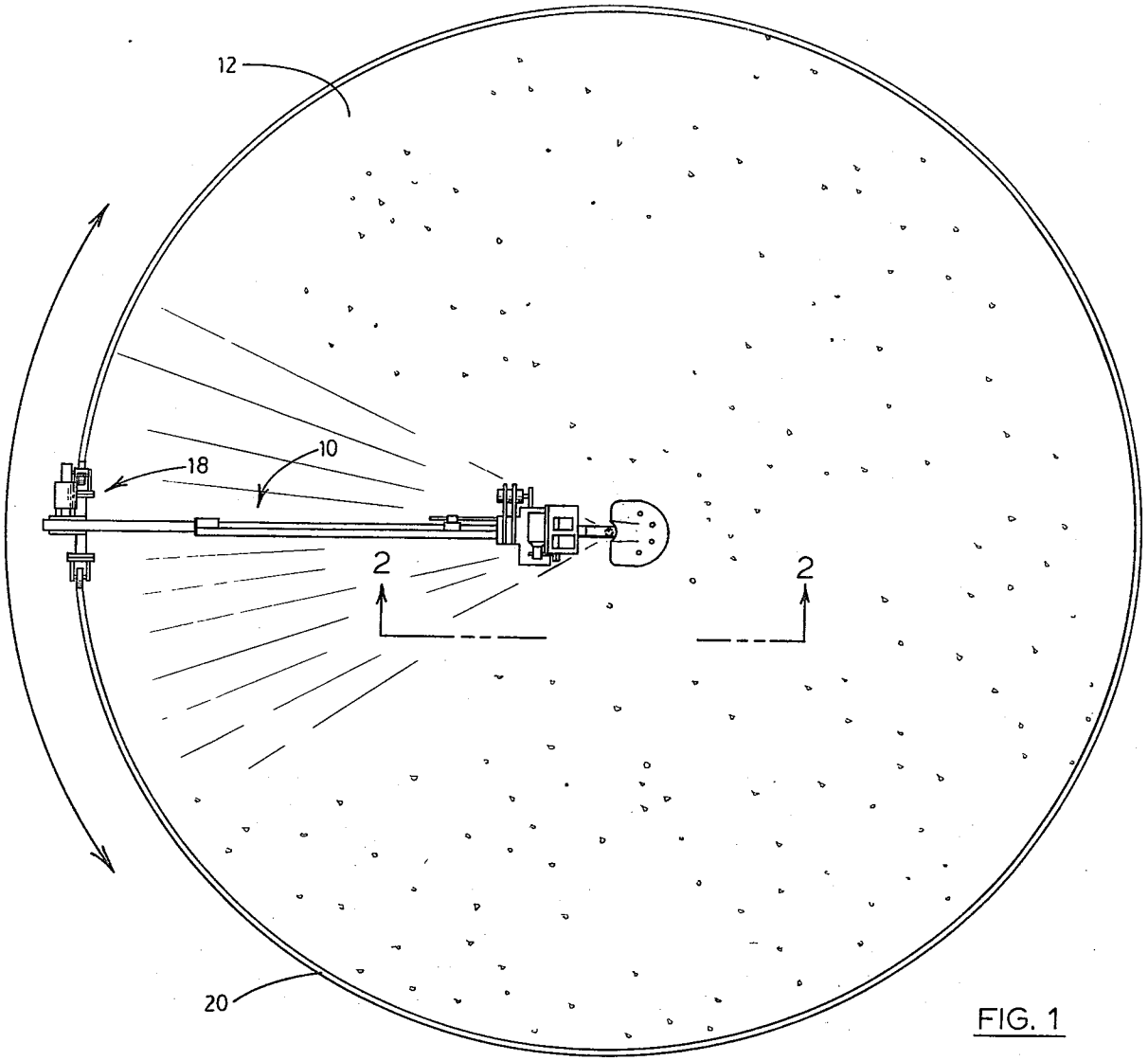
FIG. 1 is a top plan view depicting an operational environment for a troweling machine comprising a mechanized trowel embodying the principles of the instant invention.
Figure 2:
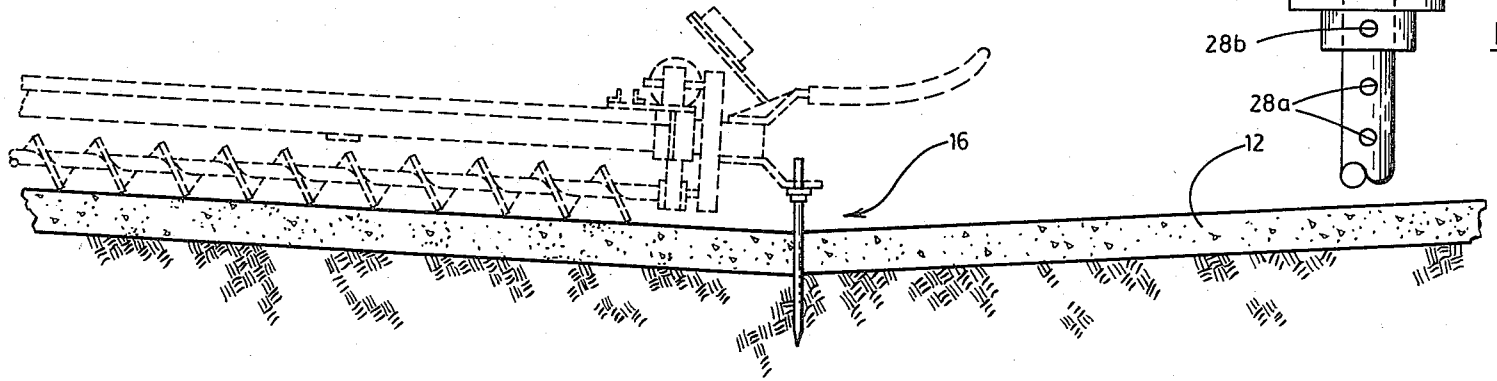
FIG. 2 is a fragmented, cross-sectional view taken generally along lines 2—2 of FIG. 2.

Referring now to the drawings, wherein like reference characters designate like or corresponding parts throughout the several views, there is shown in FIG. 1 a troweling machine, generally designated 10, embodying the principles of the instant invention. As depicted in FIG. 1, the machine is employed in finishing a concrete slab, generally designated 12, of an inverted, conical or dished-shaped configuration, as depicted in FIG. 2.

Figure 3:
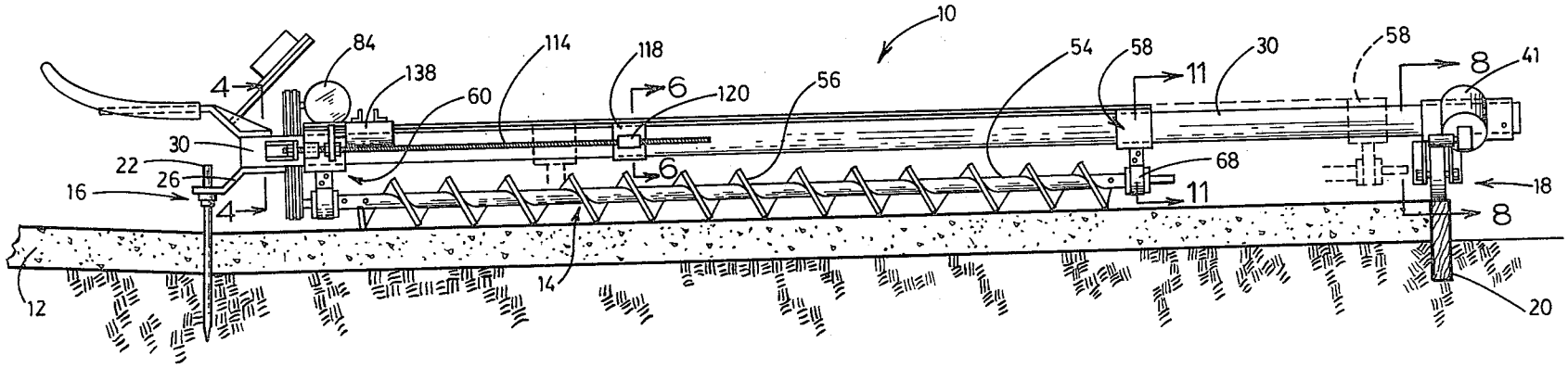
FIG. 3 is a cross-sectional view of the mechanized trowel shown in FIG. 1, but on somewhat of an enlarged scale.
Figure 7:
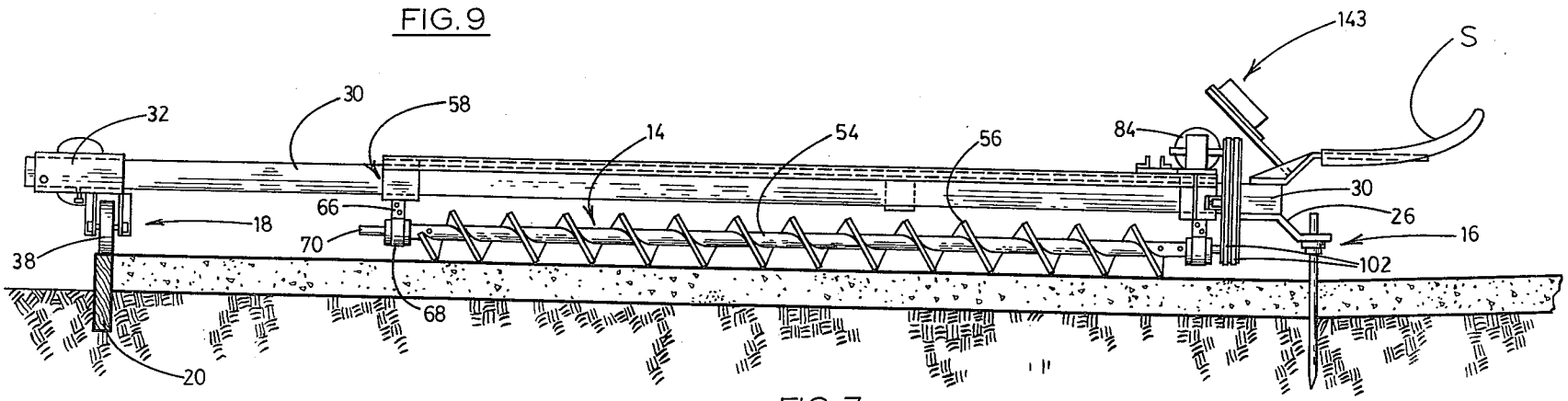
FIG. 7 is a side elevational view similar to FIG. 3, but taken from a side thereof opposite to that shown in FIG. 3.

As best illustrated in FIGS. 3 and 7, the troweling machine 10 includes an auger-shaped trowel, generally designated 14, which rests on the uppermost surface of the slab 12.

Figure 10:
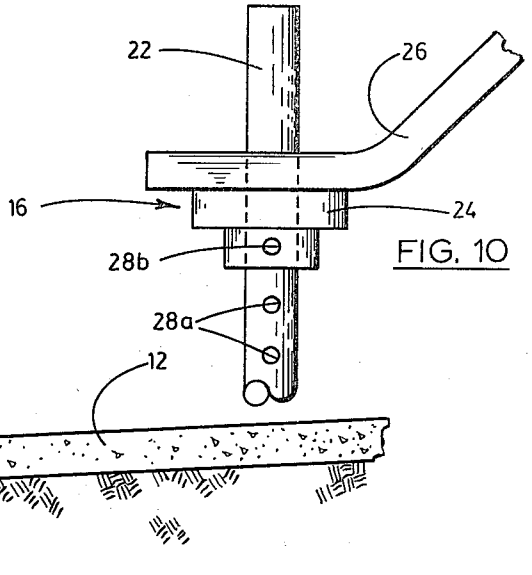
FIG. 10 is a fragmented view of an anchor assembly provided for supporting the troweling machine at one end thereof.

One end of the machine 10 is supported by an anchor assembly 16, FIG. 10, while the opposite end of the machine is transported by a truck 18. The truck 18 is supported for travel along a circular path defined about the anchor assembly by a form 20. Thus the form 20 serves as a rail for the truck, as well as a conventional form. It should now be apparent that since the form 18 may be positioned at various elevations, the machine 10 has a capability for finishing dished-shaped slabs of various planar configurations, even though it is particularly suited for finishing dished-shaped slabs of inverted conical configurations.

Referring for a moment to FIGS. 3 and 10, it can be seen that the anchor assembly 16 includes a vertically oriented anchor post 22 projected downwardly through the slab 12, into the ground where necessary, a depth sufficient to impart thereto a desired stability.

To the anchor post 22 there is affixed a bearing collar 24 which functions as a bearing for a strut 26 employed in supporting the troweling machine at one end thereof, as will hereinafter be more fully described. The collar 24 is attached to the anchor post 22 in any suitable manner. However, as shown, the anchor post 22 includes a series of diametrically extended apertures 28*a* while the collar 24 includes apertures 28*b*. The apertures 28*a* and 28*b*, when aligned, serve to receive pins, not designated, in order to accommodate vertical adjustment of the collar 24 along the anchor post 22.

The strut 26, in turn, is welded or otherwise rigidly secured to one end of the rail 30 and serves to couple the rail to the post 22 in a supported relationship therewith. The rail 30 at its opposite end is supported by the truck 18. Thus the rails 30 function as a main boom, herein referred to as a backbone, for the machine 10. It should now be apparent that the vertical position or elevation of the end of the rail 30 supported by the strut 26 may be varied and is determined by the vertical position of the collar 24 relative to the anchor post 22.

Figure 8:
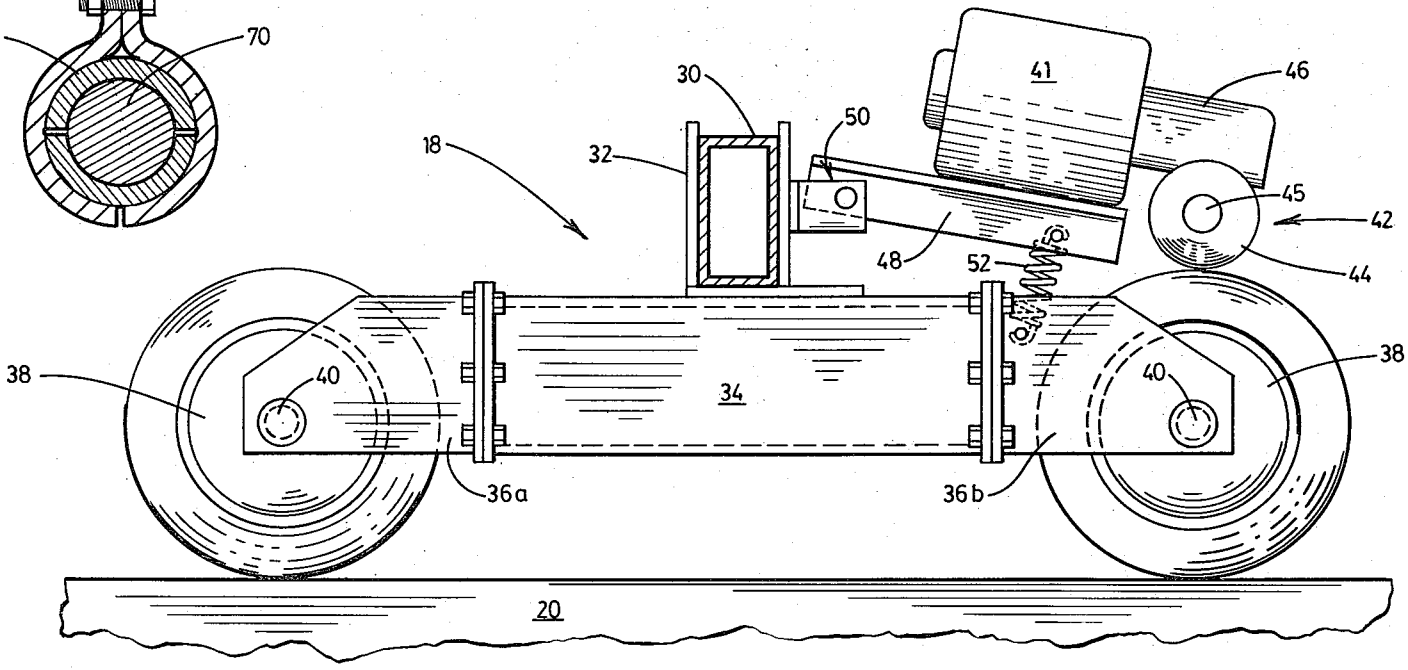
FIG. 8 is a cross-sectional view taken along lines 8—8 of FIG. 3.

With reference now to FIG. 8, it is noted that the rail 30, at one end thereof, is received in a bracket 32 welded or otherwise secured to a main beam 34 for the truck 18. In practice, the beam 34 is provided with wheel mounts 36*a* and 36*b* for a pair of mutually spaced wheels 38 pinned thereto by axles 40. As is practical, the wheel mounts 36*a* and 36*b* are coupled with the beam 34 through the use of suitable fasteners such as bolts, not designated, passing through aligned openings formed in mated flanges provided at the opposite ends of the beam 34. Of course, the beam 34 can be fabricated as an integral structure, or where so desired, the wheel mounts may be welded or otherwise secured to the beam. In any event, it is to be understood that the truck 18 serves to translate the end of the rail 30 furthermost from the anchor assembly 16 in a circular path concentrically related to the anchor post 22.

In order to impart translatory motion to the end of the rail 30, an electrically energizable motor 41 is mounted on a truck 18 and connected in driving relation with one of the wheels 38 through a suitable drive coupling forming a slip-clutch mechanism, generally designated 42. As shown, the mechanism 42 includes a friction wheel 44 mounted on a drive shaft 45 which in turn is connected to the motor 41 through a suitable gear box 46. Preferably, the motor 41 is supported by a mount 48 pivotally connected to the bracket 32 through a suitable clevis coupling generally designated 50. Thus the motor 41 is supported to move in a vertical plane in order to vary the frictional forces developed between the periphery of the wheel 38 and the friction wheel 44. A tension spring 52 having one end connected to the mount 48 and the opposite end connected to the wheel mount 36*b* is provided for continuously urging the friction wheel 44 into engagement with the periphery of the wheel 38 for thus maintaining the friction wheel 44 in driving relation with the wheel 38.

It should now be apparent that as the motor 41 becomes energized, the friction wheel 44 is driven in rotation by the shaft 45. The rotary motion thus imparted to the friction wheel is transmitted to the wheel 38 at the mated surfaces thereof. Of course, due to the inertia of the machine 10, slippage of the friction wheel 44 with repect to the periphery of the wheel 38 may be experienced in order to reduce torque loading for the motor 41, whereby the winding of the motor tends to be protected against overload.

It is important to note that the motor 41 is a reversible motor which permits the motor to be reversely driven for thereby reversing the direction in which the end of the rail 30 may be translated relative to the anchor assembly 16.

With reference again to FIGS. 3 and 7, it can be seen that the trowel 14 is suspended from the rail 30 and includes a cylindrical center body 54 having extended along its surface a helical blade 56. The pitch of the blade 56 is sufficient for advancing concrete, when in its plastic state, axially relative thereto.

In order to suspend the trowel 14 from the rail 30, a truck, generally designated 58, is provided at the end of the trowel 14 furthermost from the anchor assembly 16, while a truck 60 is provided for supporting the trowel 14 at the end thereof nearest the anchor assembly 16. Consequently, it is to be understood that the trucks 58 and 60 are mounted on the rail 30 for displacement therealong and serve to accommodate axial displacement of the trowel 14, relative to the anchor assembly 16.

Figure 11:
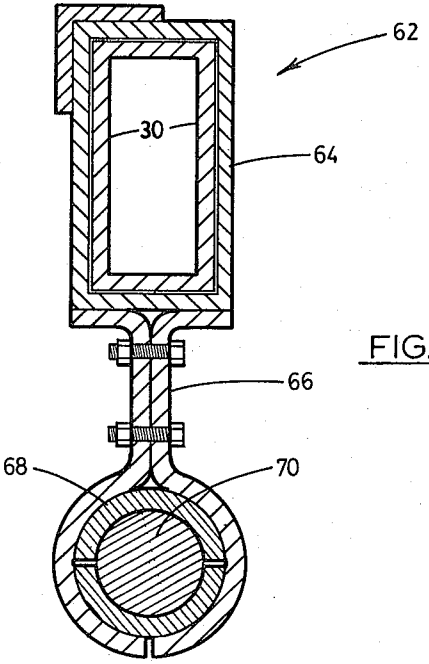
FIG. 11 is a cross-sectional view taken generally along lines 11—11 of FIG. 3.

With reference to FIG. 11, it is noted that the truck 58 serves as a support for a hanger 62. The hanger 62 includes a plain bearing sleeve 64 mounted on the rail 30 in sliding engagement therewith. From the sleeve depends a strut 66 for supporting a journal bearing 68. This bearing serves to receive a shaft-like portion 70 projected axially from the center body 54. The portion 70 functions as a bearing shaft for supporting the trowel 14, so that the bearing 68 and the portion 70 of the center body, in effect, define an axially displaceable journal which serves to support one end of the trowel 14 in suspended relation with respect to the rail 30.

Figure 5:
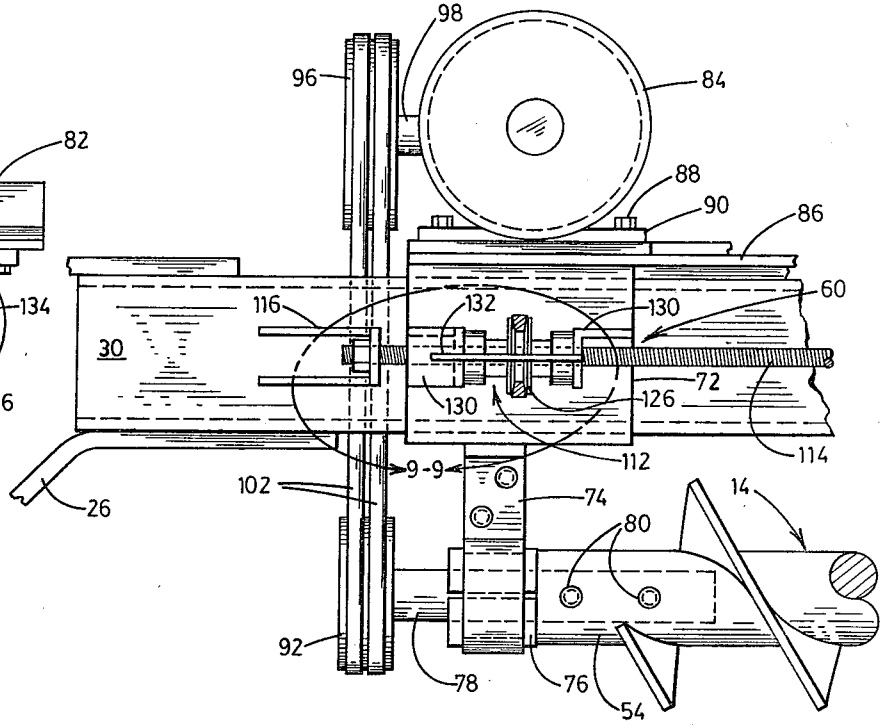
FIG. 5 is a cross-sectional view taken generally along lines 5—5 of FIG. 4.
Figure 4:
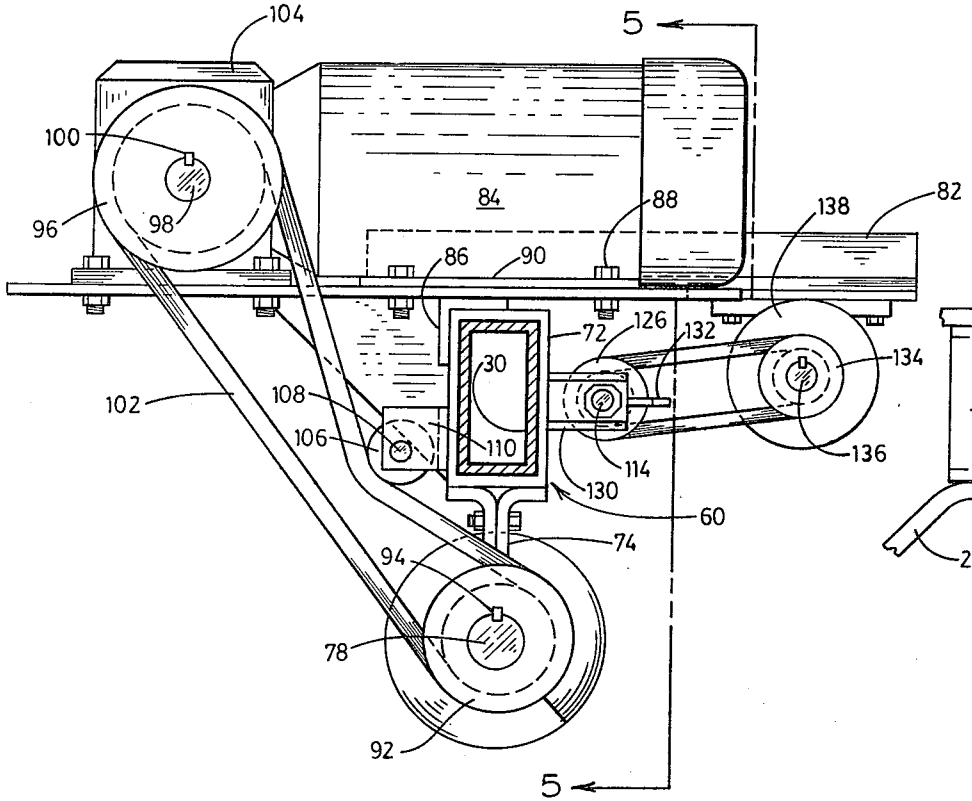
FIG. 4 is a cross-sectional view taken generally along lines 4—4 of FIG. 3.

Referring now to FIGS. 4 and 5, the truck 60 also includes a hanger, not designated, which includes a plain bearing sleeve, designated 72. The sleeve 72 is received in sliding engagement by the rail 30, in a manner similar to that of the sleeve 64. Mounted, as by welding or the like, in suspended relation with the lowermost surface of the sleeve 72, there is a strut 74. This strut serves to support a journal bearing 76 for a bearing shaft 78 projected axially from the center body 54 and pinned thereto by pins 80, as shown. Thus the trowel 14 is supported in suspension by the sleeve 72 at the innermost end of the rail 30 nearest the anchor assembly 16.

Mounted at the upper surface of the sleeve 72, and supported thereby, is a platform 82 which functions as a mount for an electrically energizable motor 84. This motor is provided for driving the trowel 14 in rotation about its longitudinal axis for purposes hereinafter more fully described. The platform 82 is connected to the sleeve through the use of a suitable platform-supporting bracket 86, welded or otherwise rigidly affixed to the sleeve 72. In practice, the motor 84 is bolted to the platform 82 through the use of bolts 88 extended through mated apertures defined in a mounting plate 90, as is provided for the motor and the platform 82. The motor 84 is thus supported for linear displacement with the trowel 14 so that the trowel 14 may be simultaneously driven in rotation as it is axially displaced relative to the anchor assembly 16.

Affixed to the end of the bearing shaft 78, there is a pair of V-belt sheaves 92. The sheaves 92 are mounted on the shaft 78 and affixed thereto through the use of a key-and-key way coupler 94, FIG. 4, of known design.

Similarly, a pair of V-belt sheaves 96 are mounted on a drive shaft 98, through the use of a key-and-key way coupling 100. The pair of sheaves 92 and 96 are interconnected through a pair of V-belts 102, also of known design. The drive shaft 98 is, in turn, connected to the motor 84 through a suitable gear box 104, FIG. 4, while a belt-tightener 106 is provided for maintaining desired tension in the belts 102. As a practical matter, the belt-tightener 106 includes a roller supported by a pin 108 having its ends affixed to a pair of members defining a bracket 110, which is in turn welded to the sleeve 72. In view of the foregoing, it is believed to be readily apparent that simply by electrically energizing the motor 84, the shaft 98 is driven through the gear box 104 for driving the shaft 78, via the sheaves interconnected by the belts 102. Upon being driven in rotation, the shaft 78, of course, transmits rotary motion to the center body 54 of the trowel 14. Since the motor 84 preferably is a reversible motor, the direction in which the trowel 14 is caused to rotate about its longitudinal axis is a reversible direction.

Figure 6:
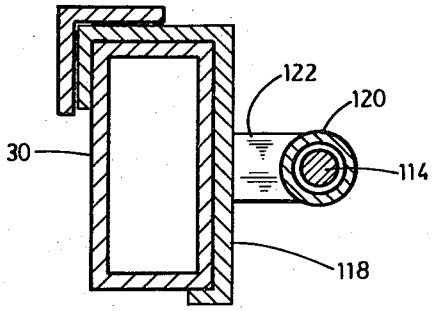
FIG. 6 is a cross-sectional view taken generally along lines 6—6 of FIG. 3.

In order to impart axial displacement to the trowel 14, a worm-and-nut assembly 112 is interconnected with the truck 60. The worm-and-nut assembly 112 includes a worm 114 having one end thereof rigidly affixed to the rail 30, through a welded bracket 116, while the opposite end of the worm 114 is supported by a hanger 118 affixed also to the rail 30, FIG. 6. As shown, the worm 114 is connected with the hanger 118 by a sleeve 120 mounted on a bracket 122. The sleeve 120 serves to receive the worm 114 in a telescopic, supported relation.

It is particularly important to note that the worm 114 is rigidly connected to the bracket 116 and is supported thereby against rotation with respect thereto through a nut, not designated, and welds suitably employed in connecting the worm with the bracket.

Figure 9:
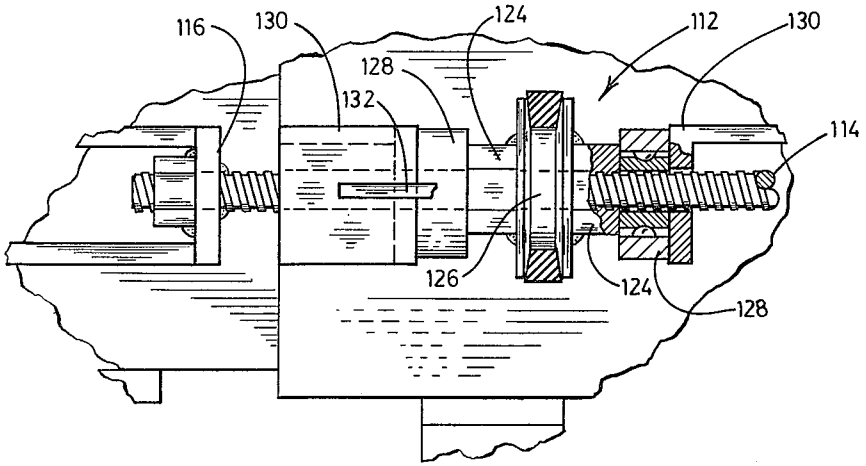
FIG. 9 is an enlarged, partially sectioned view of the structure within the area dilineated by line 9 in FIG. 5.

With reference to FIG. 9, it can be seen that a nut 124, received by the worm 114, serves to support in concentric relation a sheave 126. This sheave, in turn, is welded to the nut while thrust bearings 128 are interposed between the opposite ends of the nut 124 and members of a mounting bracket 130 welded to the truck 60. Thus the nut 124 and sheave 126 are supported for axial displacement relative to the worm 114. In practice, a bridging member 132 is provided to interconnect the members of the bracket 130 for purposes of enhancing the stability thereof.

As shown in FIG. 4, the sheave 126 is connected with a drive sheave 134 mounted on a drive shaft 136 and coupled thereto through a key-and-key-way coupling, not designated. The drive shaft 136 serves as the output shaft for an electrically energizable motor 138. This motor is a reversible motor and also is mounted on the platform 82 through the use of suitable fasteners, such as bolts, not designated.

Since the motor 138 also comprises a reversible motor it, when energized, serves to impart reversible rotation to the shaft 136. The rotary motion thus imparted to the shaft 136 is, in turn, imparted to the nut 124 via an interconnecting V-belt for the sheaves 126 and 134. Thus the sheaves 126 and the nut 124 are caused to rotate and advance along the worm.

It should now be understood that in order to advance the trucks 58 and 60 axially along the rail 30, the motor 138 is energized for driving the sheave 126 in rotation whereupon the nut 124 is caused to advance along the worm 114 as the nut 124 is advanced and axial displacement is imparted to the truck 60 to which the elements of the bracket 130 comprising the nut 124 is secured.

Figure 13:
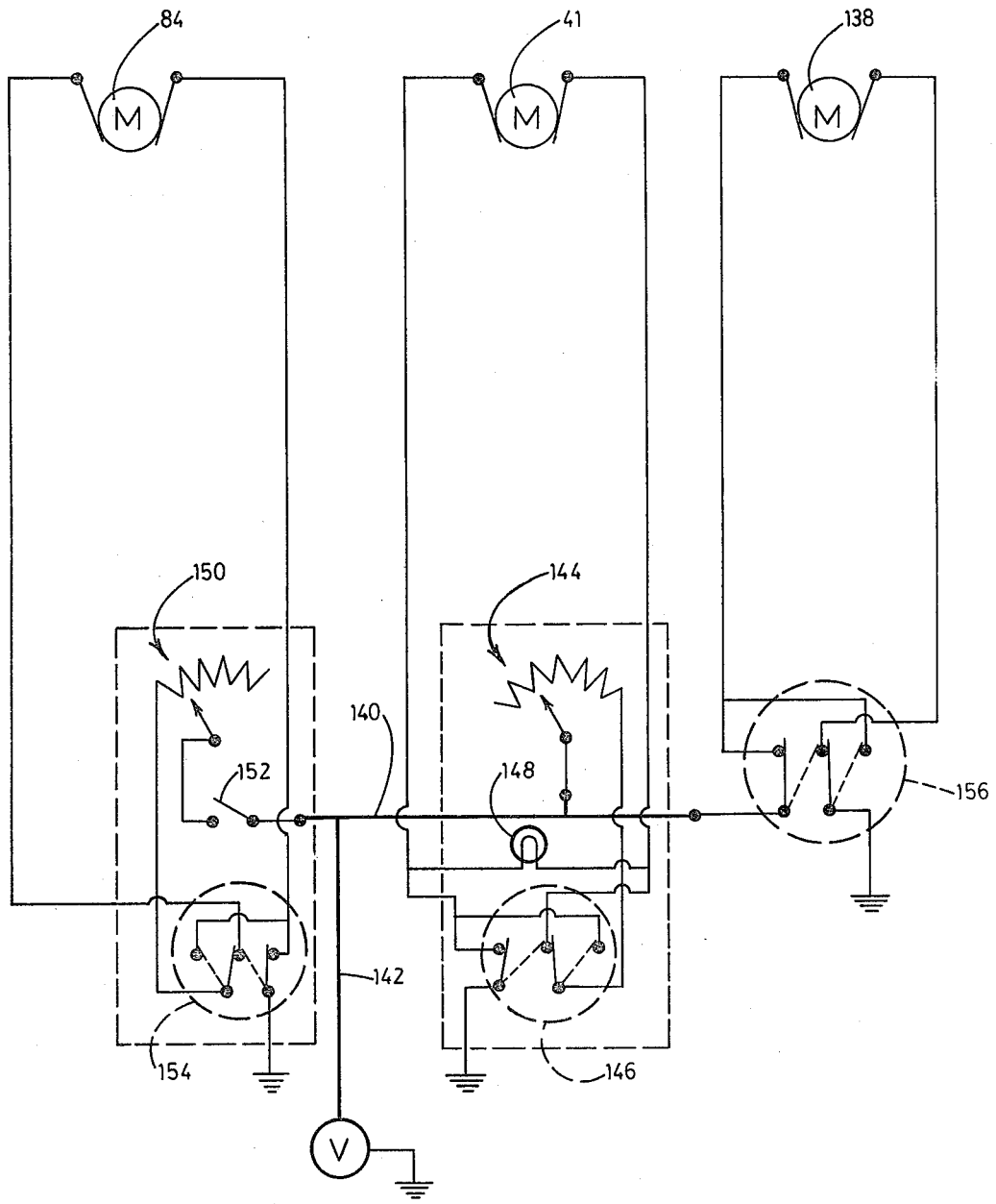
FIG. 13 is a schematic view of circuitry employed in controlling the operation of the machine embodying the principles of the instant invention.

Attention is invited to FIG. 13 wherein there is illustrated electrical circuits for driving the motors 41, 84, and 138. It will be noted that the motors 41, 84 and 138 are connected with a voltage source through a common bus bar 140 and a lead 142. As shown, the lead 142 is a flexible lead provided to connect the bus bar with a suitable voltage source. For the sake of convenience, the source, as shown, comprises a DC source, designated V, of conventional design. The voltage may, for the sake of simplicity, be deemed to be a rectified AC voltage, although various AC-to-DC circuits may be employed for utilizing AC voltages.

It is noted that through the bus bar 140 there is connected a variable resistence 144, having its output end connected to a double-pole, double-throw switch 146, which accommodates application of a voltage of a reversible polarity across the motor 41. The switch 146 therefore serves to control the speed and direction of rotation for the output shaft of the motor. As a practical matter, a lamp 148 is interconnected with a switch 146 to be illuminated upon the switch 146 being closed for energizing the motor 41.

Similarly, a variable resistence 150 is connected with the bus bar 140 through a manually operable switch 152. The output end for the resistence 150 is connected with a switch 154, also comprising a double-pole, double-throw switch. Thus voltage of a reversible polarity may be applied across the motor 84 in alternative and opposite directions for reversely energizing the motor 84. Consequently, through a manipulation of the resistence 150 and the switch 154, both the direction and the speed at which the trowel 14 is driven is selectively controlled.

Finally, there is connected between the motor 138 and the bus bar 140 a double-pole, double-throw switch for alternately applying DC voltages across the motor 138, in reversing directions, for purposes of advancing or retracting the trowel 14.

A control panel 143, FIG. 7, is mounted on the beam 30 in a suitable manner and thus provided for supporting the control switches for the motors 41, 84, and 138. Where so desired, a seat S is mounted on the beam 30 for supporting an operator. However, the seat S may be eliminated if so desired.

Figure 12:
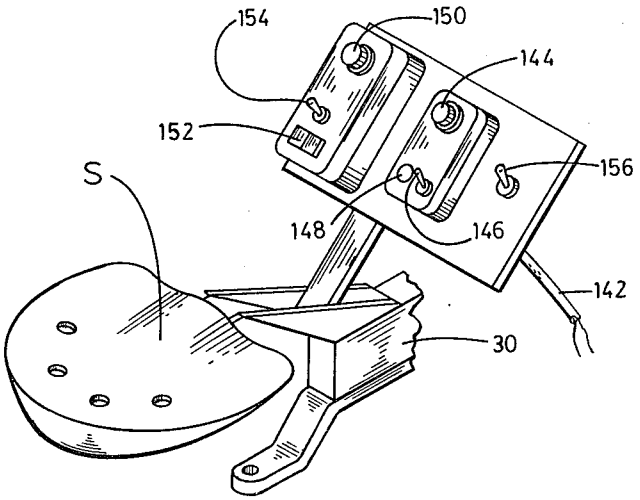
FIG. 12 is a fragmented, perspective view depicting a control panel for the operator of the trowel.

At this juncture, it is noted that the switches 146, 154 and 156 are illustrated as toggle switches, FIG. 12, but other switching devices can be employed equally as well. Moreover, while the motors 41, 84, and 138 are herein described as reversible DC motors and the voltage source V is referred to as a source of DC voltage, it is important to note that various AC motors and control circuits which accommodate a reversing of the direction of the output obtained therefrom can be employed without departing from the invention hereinafter claimed.

OPERATION

It is believed that in view of the foregoing description, the operation of the invention hereinbefore disclosed and hereinafter claimed is readily apparent. However, in the interest of completeness of understanding, the operation of the invention is, at this point, briefly reviewed.

With the trowel assembled in the manner hereinbefore described, it is readied for operation by placing the wheels 38 of the truck 18 on the upper surface of the form 20 and the strut 26 in mated relation with the anchor assembly 16.

The bus bar 140 is energized by connecting the cable 142 to a source V of DC voltage. An operator seated on the seat S now simultaneously closes switches 146 for thus energizing the motor 41 in a suitable direction, and the switches 152 and 154 for energizing the motor 84 in a suitable direction. Upon the motor 41 being energized, the truck 18 is advanced in response to transfer of mechanical power from the drive shaft 45 to one of the wheels 38, via the coupling 42. At the same time, the trowel 14 is driven in rotation in response to an energization of the motor 84, via the switch 150. Depending upon the direction at which the voltage is applied across the motor 84, the trowel 14 is driven in rotation about its longitudinal axis, via the V-belt 102, trained about the V-belt sheaves 92 and 96. In order to control the speed at which the truck 18 is advanced, the resistence 144 is manipulated by the operator. Similarly, in order to control the speed of the trowel 14, the resistence 150 is manipulated by the operator. In practice, it is highly desirable to "push" wet cement, or cement in its plastic state, outwardly toward the truck 18 as the truck reverses the form 20. Hence, the direction and rate of rotation for the trowel 14 is in operation varied for controlling the direction and speed of the trowel.

It is also noted that as the trowel is caused to traverse a circular path, for purposes of simultaneously spreading and troweling the cement in response to a rotation of the center body 54 and the troweling and the pushing function of the helical blade 56. Of course, in order to position the trowel 14 along the beam 30 as the troweling and pushing of the cement is effected, the switch 156 is selectively closed for applying a reversable voltage across the motor 138. Thus the trowel 14 is advanced and retracted along the beam 30, as desired by the operator.

As illustrated in FIGS. 1 and 2, the operation of the machine 10 serves to finish the slab to a circular or dished-shaped configuration, the diameter of which is determined by the diameter of the form 20, while the center of the slab is in a plane lower than the plane of the form. To control the shape or grade of the slab, the collar 24 for the strut 26 is repositioned and the pins inserted through apertures **28*a* and 28*b*** for thus repositioning the innermost end of the trowel, relative to the slab, and in a vertical plane.

With the machine thus assembled and operated in the manner hereinbefore described, it is believed to be readily apparent that the troweling machine of the instant invention provides a practical solution to the problems heretofore encountered in fabricating slabs of configurations particularly adapted for use as foundations for wine tanks and the like.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. In a method for mechanically finishing dished-shaped concrete slabs of inverted conical configurations the steps comprising:

positioning an elongated blade of a helical configuration on the upper surface of a body of cement in a plastic state; and simultaneously pushing the cement upwardly, outwardly, and annularly relative to one end of said blade by rotating said blade about its longitudinal axis while simultaneously translating the opposite ends of the blade in a circular path about the one end of the blade.

2. In a mechanized trowel for finishing concrete slabs, the combination comprising:

A. a body of an elongated configuration supported for rotational displacement about its longitudinal axis and having a helical troweling blade extended along the surface thereof adapted to engage the upper surface of a body of cement to be troweled;

B. means including a rail extended in parallelism with said body supporting said body for linear displacement therealong;

C. means including a truck supporting one end of said rail for translational displacement about a further axis perpendicularly related to the longitudinal axis of the body and passing through the opposite end thereof; and D. means connected in driving relation with said body for imparting thereto rotational, linear displacement and translational displacement.

3. A combination as defined in claim 2 further comprising means including an anchor post adapted to be vertically implanted in the body of cement and connected in supporting relation with the opposite ends of said rail for restraining said rail against axial displacement relative to said further axis.

4. A combination as defined in claim 3 wherein said rail supports said one end of said body at an elevation greater than that at which the rail supports the opposite end of said body, whereby said slabs are caused to assume an inverted conical configuration as the cement is smoothed by said trowel in response to rotational and translational displacement of said body.

5. A combination as defined in claim 3 further comprising an operator station disposed at the opposite end of said rail and a plurality of motor-control, circuit switching means located at said station and connected to said energizable motor, each independently of the other, adapted to be manipulated for reversely energizing said motor.

6. A combination as defined in claim 3 wherein said truck comprises a wheel-supported truck having a frame, a pair of ground wheels connected to said frame and one motor of said plurality mounted on the frame and connected in driving relation with at least one ground wheel of said pair of ground wheels.

7. A combination as defined in claim 6 further comprising a pair of mutually spaced trucks mounted on said rail in sliding relation therewith connected with the end portions of said body and supporting said body in suspended relation with respect to said rail, and a drive train including an elongated worm connected to said rail and supported in parallelism with said body, a nut mounted on said worm and connected with one truck of said pair of mutually spaced trucks, and a belt-driven sheave mounted on said nut and connected with another motor of said plurality for imparting driven rotation to the nut for advancing the trucks of said mutually spaced pair.

8. A combination as defined in claim 6 further comprising means including a friction drive for connecting said one motor to said one ground wheel.

9. In a machine for finishing concrete slabs of dished-shaped configurations a mechanized trowel comprising:

A. an elongated body supported for rotational displacement about its longitudinal axis and having a blade of a helical configuration extended along its surface;

B. means including a rail supporting said body for translational displacement about a further axis passing vertically through a first end of the rail including a truck connected to the opposite end of the rail in supporting relation therewith and anchor means for supporting the first end of the rail against axial displacement relative to said further axis;

C. suspension means coupling said body to said rail and supporting said elongated body for axial displacement relative to said further axis; and D. means for imparting to said body simultaneous, rotational translational and linear displacement.

* * * * *